United States Patent [19]

Marion

[11] 4,445,484

[45] May 1, 1984

[54] MECHANICAL FUEL INJECTION DEVICES, MAINLY FOR DIESEL ENGINES

[75] Inventor: Gerard Marion, Rhone, France

[73] Assignee: Renault Vehicules Industriels, Rhone, France

[21] Appl. No.: 259,282

[22] Filed: Apr. 30, 1981

[30] Foreign Application Priority Data

Apr. 30, 1980 [FR] France ..... 80 10121

[51] Int. Cl.[3] ..... F02D 1/06; F02M 47/00

[52] U.S. Cl. ..... 123/502; 123/506; 123/387; 137/625.66; 417/265; 417/506

[58] Field of Search ..... 123/506, 502, 501, 500, 123/458, 357, 387; 137/625.66, 625.26; 417/506, 507, 508, 440, 441, 265

[56] References Cited

U.S. PATENT DOCUMENTS

| | | | |
|---|---|---|---|
| 2,001,336 | 5/1935 | Vago | 417/506 |
| 2,006,879 | 7/1935 | Beneder | 417/506 |
| 2,077,259 | 4/1937 | Planiol | 123/451 |
| 2,880,675 | 4/1959 | Bessiere | 417/507 |
| 3,358,662 | 12/1967 | Kulke | 123/502 |
| 3,699,939 | 10/1972 | Eckert | 123/506 |
| 3,779,225 | 12/1973 | Watson | 123/458 |
| 3,949,645 | 4/1976 | Masclet | 137/625.66 |
| 3,958,495 | 5/1976 | Bernhoft | 137/625.66 |
| 4,240,467 | 12/1980 | Blatt | 137/625.66 |
| 4,304,205 | 12/1981 | Bauer | 123/502 |

*Primary Examiner*—Charles J. Myhre
*Assistant Examiner*—Carl Stuart Miller
*Attorney, Agent, or Firm*—Remy J. VanOphem

[57] ABSTRACT

A mechanical fuel injection device having a pumping piston and a pressure chamber ahead of the piston and connected to at least one injector by means of a linking channel. A slide valve is fitted to slide in a bore the central part of which crosses the linking channel. The slide valve is subject to the biasing action of spring means and to that of a pressure chamber. In the rest position of the slide valve, the linking channel communicates with a fuel feed circuit. A control pressure applied in the chamber moves the slide valve forward, blocking the circuit, but allowing injection by means of a circular throat allowing the fuel to flow along the linking channel.

11 Claims, 3 Drawing Figures

16
21
15
14
11
17
6
8
19
7
20
18
12
9
10
5
4
13
2

MECHANICAL FUEL INJECTION DEVICES, MAINLY FOR DIESEL ENGINES

BACKGROUND OF THE PRESENT INVENTION

The present invention concerns an improvement to mechanical fuel injection devices mainly intended for diesel engines.

The primary object of the present invention is providing an injection device adaptable to injection pumps placed in line as well as to distributing pumps or to mechanically controlled injector-pumps.

SUMMARY OF THE PRESENT INVENTION

An injection device according to the invention includes a pumping piston, a cam working with the rear of this piston to impart to it a longitudinal reciprocating movement and, in front of the piston, a pressure chamber connected to at least one injector by means of a linking channel. A slide valve is fitted to slide in a bore, the central portion of which crosses the linking channel. The read portion of the slide valve forms a pressure chamber connected to a control channel in the rear part of this bore. A fuel feed circuit opens into the front part of the bore. Spring means are provided tending to recall the slide valve permanently rearwardly. A circular throat is provided near to the front edge of the cylindrical bearing by means of which the slide valve is adjusted in the bore.

Thus, when the slide valve is subject only to the action of the spring means, it occupies a rest position in which the linking channel communicates with the fuel feed circuit. When an appropriate pressure is established in the control channel, the slide valve is moved in the forward direction, blocking the fuel feed circuit but allowing the circulation of fluid in the linking channel by means of the circular throat. As soon as the pressure falls again in the control channel, the slide valve returns to its rest position.

According to an additional characteristic of the invention, the spring means is a coil spring located in a chamber of greater diameter than the bore and is situated at the front of this bore, while the slide valve includes, in front of its cylindrical bearing, a stem the front of which is fixed to a pierced shoulder. The rear of the spring bearing on this shoulder abuts the rear of the said chamber of greater diameter than the bore, so as to fix the rest position of the slide valve.

According to an additional characteristic of the invention, the control channel is put under pressure by means of a control block independent of the cam-driven mechanical pumping system.

According to an additional characteristic of the invention, the control block is electronic.

BRIEF DESCRIPTION OF THE DRAWINGS

The attached drawing, given by way of non-limiting example, will allow the characteristics of the invention to be better understood.

DETAILED DESCRIPTION OF THE PREFERRED EMBODIMENTS

Figure 1:
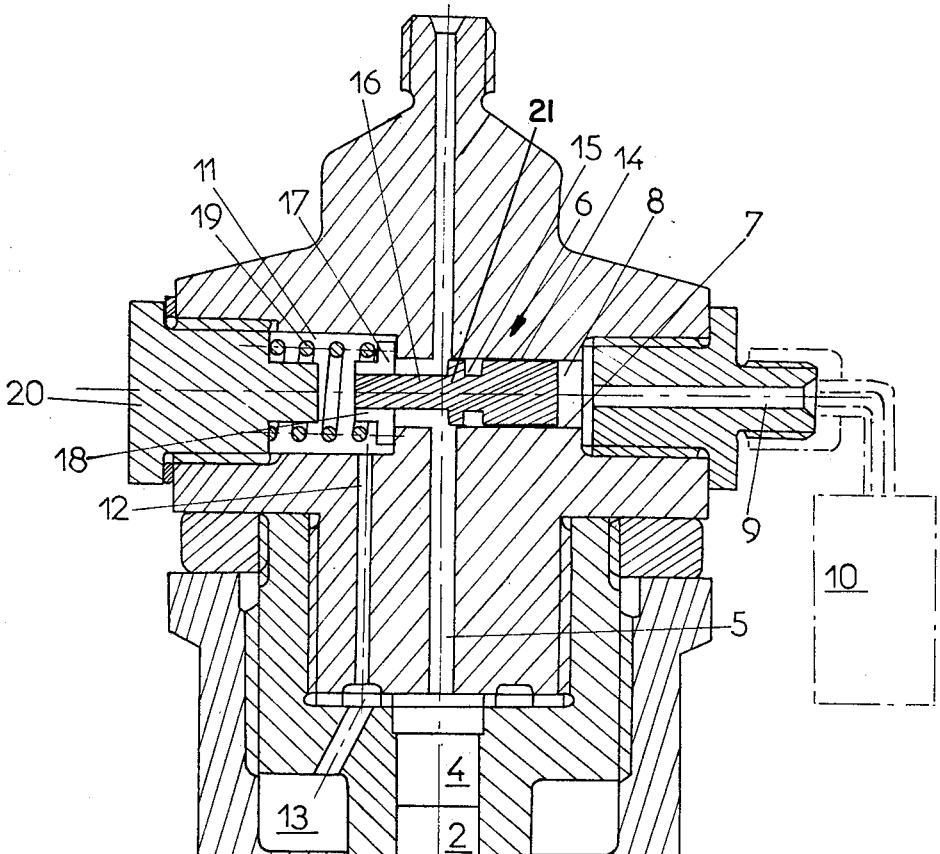
FIG. 1 is a view in axial section of an injection device according to the invention.

In FIG. 1 is shown an injection device according to the invention. This device uses a traditional pump 1 solely as a pressure generator. All the components which normally carry out the functions of measurement of the quantity injected and of variation in the degree of advance having been dispensed with.

The pump 1 therefore includes a pumping piston 2 and a cam 3 which act with the rear or lower end of the piston 2 to impart a reciprocal longitudinal motion along its axis. In front of the piston 2, a pressure chamber 4 is provided into which a linking channel 5 opens axially. The other end of the linking channel 5 communicates directly with the injector or injectors to be supplied.

A slide valve 6 is fitted to slide in a bore 7 the central part of which crosses the linking channel 5, the axis of the bore 7 being perpendicular to that of the channel 5. The rear face of the slide valve 6 forms a pressure chamber 8 in the rear part of the bore 7. The pressure chamber 8 is connected with a control channel 9. This channel is put under pressure at the appropriate time by means of an electronic control block 10. At the front, the bore 7 opens into a chamber 11, of larger diameter. A fuel feed circuit 12, connected, for example, to a gallery 13 fed with fuel at low pressure also opens into the chamber 11.

Figure 3:
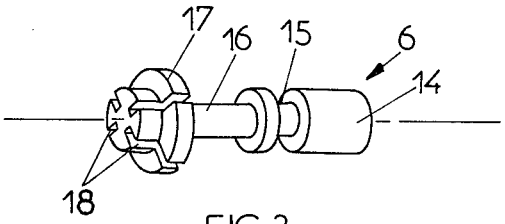
FIG. 3 is a view in perspective of the slide valve of the device of FIG. 1.

The slide valve 5 is adjusted to slide in the bore 7 by means of a cylindrical bearing 14 provided near to its front edge with a circular throat 15 (see FIG. 3). A collar 21 is defined at the front portion of the bearing 14 ahead of the throat 15. At the front of the cylindrical bearing 14, the slide valve carries a stem 16, of smaller diameter, the front end of which is affixed to a pierced shoulder 17 in the form of a cross, the branches of which are separated by radial slots 18.

The chamber 11 encloses a coil spring 19 working in compression. At the front, this spring bears against a threaded plug 20 which insures the sealing of the chamber 11, while at the rear this spring bears against the above-mentioned shoulder 17. The mechanism allows a rest position for the slide valves, corresponding to FIG. 1, in which the shoulder 17 butts against the rear end of the chamber 11 and the alternate position illustrated in FIG. 2. The radial slots 18 insure the free circulation of fuel between the chamber 11 and the bore 7.

The operation of the present invention is as follows: With the slide valve 6 in its rest position in which the linking channel 5 communicates freely with the front of the bore 7 and the chamber 11, the fuel pumped by the pump 1 into the gallery 13 during the descent of the piston 2 flows successively through the circuit 12, the chamber 11, the front of the bore 7, the lower part of the linking channel 5 and finally, into the pressure chamber 4 to fill the pressure chamber. As the piston 2 rises again, the fuel is initially driven back into the gallery 13, taking the same pathway through these passages, but in the opposite direction.

Figure 2:
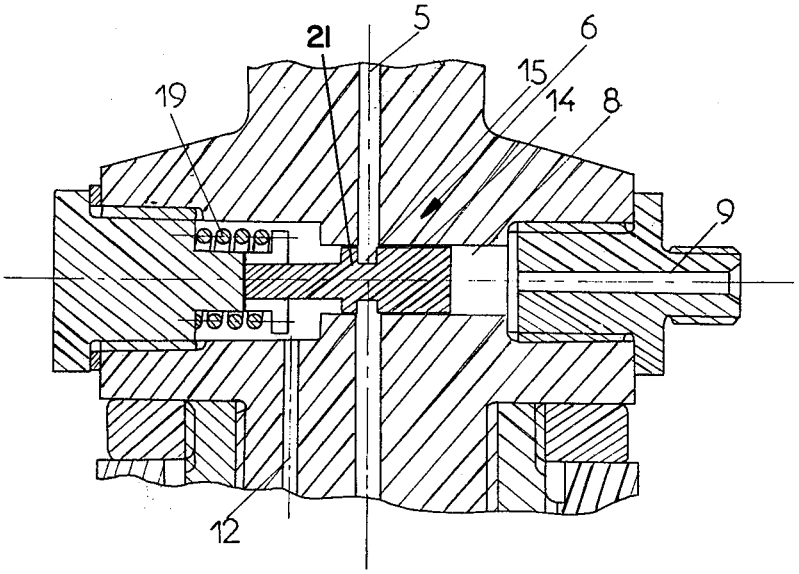
FIG. 2 is a part view of the device in FIG. 1, showing the operation thereof.

At a precise time chosen for the beginning of an injection operation, the block 10 sets up a hydraulic control pressure in the chamber 8 by means of the channel 9. Under the effect of this control pressure, the slide valve 6 moves forward, compressing the spring 19 as shown in FIG. 2. The slide valve 6 stops in the predetermined position which corresponds to the following description. Primarily the collar 21 of the cylindrical throat 15 completely blocks the chamber 11, thereby cutting off completely the linking channel 5 from the circuit 12. Secondly, the cylindrical throat 15, which has moved to be opposite the linking channel 5, allows the free passage of the fuel along the linking channel 5.

The fuel driven by the piston 2 from the pressure chamber 4 must pass through the linking channel 5 to reach the injector or injectors since there is no other place for the fuel to travel. It should be noted that a passage may be formed through the slide valve 16 by use of a bore drilled transversely through the valve instead of the throat 15.

At a precise predetermined time chosen for the end of the injection operation, the pressure previously established by the block 10 in the chamber 8 is removed. The slide valve 6, which is then driven backwards by the spring 19, is again restored to its rest position.

One of the principal objects of the invention is controlling, in a totally independent manner, the output and the advance of an injection, setting the output and obtaining the advance by a hydraulic control pressure independent of the injection pressure, and this control lending itself well to an intensive use of electronics.

One of the advantages of the device described above is that the control block 10 is independent of the pumping system and, therefore, may be common to several types of pistons and cylinders. This allows easy interchangeability and a flexibility of adaptation.

The device according to the invention may equally easily be adaptable to other types of pumps. For example, if may be used for pumps in line, fitted to engines where a camshaft controls simultaneously several injection pumps, each injection pump being associated with a particular cylinder.

It may also be used for distributing pumps, fitted to engines in which a single injection pump carries out the supply of several injectors by means of a distributing mechanism or for injector pumps fitted to engines where a mechanically-controlled injector-pump is fitted directly above each cylinder.

The scope of the invention will not be exceeded by making minor modifications in the device described, such as would be apparent to a person skilled in the art. For example, the circular throat 15 could be replaced by a transverse drilling in the slide valve 6 or by any other passage, whether fixed in the slide valve 6 or not.

What is claimed as novel is as follows:

1. An injection device for injecting a fluid, said injection device comprising:

housing means;

fluid supply means;

a first bore in said housing means, said first bore having a first end portion provided with a first opening and a second end portion opposite said first end portion and provided with a second opening, said second opening being adapted for interconnection with injection means;

a second bore in said housing means, said second bore being larger in diameter than said first bore, said second bore having a first end portion and a second end portion opposite said first end portion and further having a portion intermediate said first and second end portions of said second bore crossing said first bore at a predetermined location between the first and second end portions thereof;

a first port in said second bore proximate said predetermined location and in fluid communication with said first end portion of said first bore;

a second port in said second bore proximate said predetermined location and in fluid communication with said second end portion of said first bore;

piston valve means reciprocably and sealably disposed in said second bore such as to be reciprocable across said first bore to selectively open and close said first and second ports, said piston valve means sealingly dividing said second bore into a first chamber adjacent to said first end portion thereof and a second chamber adjacent to said second end portion thereof, said piston valve means further selectively sealing said first and second ports;

first passageway means through said piston valve means, said first passageway means being open to said first chamber selectively simultaneously registrable with said first and second ports to permit fluid flow between all of said first end portion of said first bore, said second end portion of said first bore and said first chamber of said second bore, in a first predetermined position of said piston valve means;

second passageway means through said piston valve means, said second passageway means being selectively registrable with said first and second ports to permit fluid flow therebetween without permitting fluid flow between said first chamber and said first bore, in a second predetermined position of said piston valve means;

third passageway means through said housing means interconnecting said fluid supply means with said first chamber of said second bore;

first selectively operable pressurizing means interconnected with said first end portion of said first bore to pressurize said fluid therein;

biasing means interposed said housing means and said piston valve means, said biasing means biasing said piston valve means into said first predetermined position; and second selectively operable pressurizing means interconnected with said second chamber of said second bore to pressurize said fluid in said second chamber so as to generate a pressure differential between said first and second chambers and to thereby selectively overcome said biasing means and move said piston valve means into said second predetermined position said second selectively operable pressurizing means being operable independently of said first selectively operable pressurizing means such that, when said piston valve means is in said first predetermined position, said first selectively operable pressurization means is in fluid communication with said fluid supply and, thus, provides only minimal pressurization whereas when said piston valve means is in said second predetermined position, said first selectively operable pressurizing means pressurizes said fluid in said first bore.

2. The injection device of claim 1, wherein said first selectively operable pressurizing means comprises:

a third bore in said housing means interconnected with said first end portion of said first bore;

a compression piston means reciprocably and sealably disposed within said third bore, said second piston means being selectively operable to reciprocate within said bore so as to pressurize said fluid in said first bore; and drive means selectively operable to reciprocate said compression piston means to pressurize said fluid.

3. The injection device of claim 1 further comprising:

an enlarged cavity in said housing interposed said fuel supply means and said first chamber of said second bore;

an annular shoulder formed in said housing between said enlarged cavity and said first chamber of said second bore; and an enlarged head portion extending from said piston valve means and disposed within said enlarged cavity, said enlarged head cooperating with said annular shoulder to define said first extreme position of said piston valve means, said first passageway through said valve means comprising a passageway extending partially through said enlarged head portion of said piston valve means.

4. The injection device of claim 1, wherein said second passageway comprises an annular channel in the peripheral surface of said piston valve means selectively simultaneously registrable with said first and second ports of said second bore.

5. The injection device of claim 3, wherein said biasing means biasing said piston valve means into said first predetermined position comprises a spring disposed in said enlarged cavity and interposed said housing means and said enlarged head portion of said piston valve means to bias said enlarged head portion of said piston valve means against said annular shoulder.

6. The injection device of claim 1, wherein said second pressurized means is regulated by an electronic timing means.

7. A fuel injection device for injection fluid fuel into fluid fuel combustion device, said fuel injection device comprising:

a housing means;

fuel supply means;

a first partial bore in said housing means, said first partial bore having a first end portion having a first opening and a second end portion opposite said first end portion and having a second opening;

a second partial bore in said housing means said second partial bore having a diameter larger than said first partial bore and further having a first end portion having a first opening and a second end portion opposite said first end portion and disposed adjacent to said second end of said first partial bore and interconnected with said second end of said first partial bore for fuel flow therebetween;

compression piston means reciprocably and sealably disposed within said second partial bore, said compression piston means being selectively operable to reciprocate within said second bore to pressurize said fuel in said second end portion thereof;

a third bore in said housing means, said third bore having a larger diameter than said first partial bore, said third bore further having a first end portion and a second end portion opposite said first end portion and a third portion intermediate said first end portion and said second end portions crossing said first partial bore at a predetermined location between said first end portion and said second end portion thereof;

a first port proximate said predetermined location, said first port being formed in said third bore and being opened into the portion of said first partial bore associated with said first end portion of said first partial bore;

a second port formed in said third bore Proximate said predetermined location and opened into the portion of said first partial bore associated with said second end portion of said first partial bore;

piston valve means having a cylindrical piston valve portion reciprocably and sealably disposed in said third bore such as to be reciprocable across said first partial bore to selectively open and close said first and second ports, said cylindrical piston valve portion sealingly dividing said third bore into a first chamber adjacent to said first end portion and a second chamber adjacent to said second end portion thereof;

an enlarged cavity in said housing means adjacent to said first chamber of said third bore and in fluid communication therewith;

an annular shoulder formed between said enlarged cavity and said third bore;

an enlarged head portion of said piston valve means interconnected with said cylindrical piston portion thereof and movably disposed within said cavity, said enlarged head portion selectively abutting said annular shoulder in a first predetermined position of said piston valve means;

first passageway means through said piston valve means selectively simultaneously registrable in said first predetermined position of said piston valve means with said first and second ports to permit fluid flow between said first chamber of said third bore and said first and second ports;

second passageway means through said cylindrical piston valve portion of said piston valve means selectively simultaneously registrable in a second predetermined position of said piston valve means with said first and second ports to permit fluid flow therebetween without permitting fluid flow between said first and third bores;

third passageway means through said housing means interconnecting said fuel supply means with said enlarged cavity;

biasing means disposed in said enlarged cavity and interposed said housing means and said enlarged head portion of said piston valve means, said biasing means biasing said piston valve means into said first predetermined position; and selectively operable pressurizing means interconnected with said second chamber of said third bore to pressurize said fuel in said second chamber so as to generate a pressure differential between said first and second chambers and to thereby selectively overcome said biasing means and move said piston valve means into said second predetermined position said second pressurizing means being operable independently of said compression piston such that, when said piston valve means is in said first predetermined position, said compression piston is in fluid communication with said fluid supply and, thus, provides only minimal pressurization whereas when said piston valve means is in said second predetermined position, said compression piston pressurizes said fluid in said first and second partial bores.

8. The fuel injection device of claim 7, wherein said second passageway means comprises an annular channel in said cylindrical piston valve portion selectively registrable in said second predetermined position of said piston valve means with said first and second ports.

9. The fuel injection device of claim 7, wherein said biasing means biasing said piston valve means into said first predetermined position comprises a helical spring disposed in said enlarged cavity and interposed said housing means and said enlarged head portion of said piston valve means.

10. The fuel injection device of claim 7, wherein said selectively operable pressurizing means is regulated by an electronic timing means.

11. The fuel injection device of claim 7, wherein said second passageway means comprises an annular channel in the peripheral surface of said cylindrical piston valve portion of said piston valve means, said annular channel being selectively simultaneously registrable with said first and second ports of said third bore.

* * * * *

UNITED STATES PATENT AND TRADEMARK OFFICE

CERTIFICATE OF CORRECTION

PATENT NO. : 4,445,484

DATED : May 1, 1984

INVENTOR(S) : Gerard Marion

It is certified that error appears in the above-identified patent and that said Letters Patent is hereby corrected as shown below:

Column 1, line 23, delete "read" and insert ---- rear ----.

Column 1, line 47, after "which" insert ---- end ----.

Column 1, line 49, delete "said" .

Column 1, line 65, delete "part" and insert ---- partial ----. Same line, delete "in" and insert ---- of ----.

Column 2, line 6, after "All" insert ---- of ----.

Column 2, line 9, delete "having been dispensed with." and insert ---- are removed or bypassed. ----.

Column 2, line 18, after the numeral "7" insert a comma ---- , ----.

Column 2, line 20, before "channel" insert ---- linking ----.

Column 2, line 23, delete "This" and insert ---- The control ----.

UNITED STATES PATENT AND TRADEMARK OFFICE

CERTIFICATE OF CORRECTION

PATENT NO. : 4,445,484

DATED : May 1, 1984

INVENTOR(S) : Gerard Marion

It is certified that error appears in the above-identified patent and that said Letters Patent is hereby corrected as shown below:

Column 2, line 30, delete the numeral "5" and insert the numeral ---- 6 ----.

Column 2, line 44, delete "valves" and insert ---- valve 6 ----.

Column 2, line 56, before "finally," insert a comma ---- , ----.

Column 2, line 62, before "block 10" insert ---- electronic control ----.

Column 2, line 63, before "channel 9." insert ---- control ----.

Column 2, line 65, before "spring 19" insert ---- coil ----.

Column 2, line 68, after "Primarily" insert a comma ---- , ----.

Column 3, line 10, delete the numeral "16" and insert the numeral ---- 6 ----.

Column 3, line 29, after "may" insert ---- be ----.

Column 3, line 30, delete "easily be" and insert ---- easily ----.

Column 3, line 31, delete "if may" and insert ---- it may ----.

Column 4, line 64, delete "second" and insert ---- compression ----.

Column 4, line 66, before "bore" insert ---- third ----.

Column 5, line 1, after "housing" insert ---- means ----. Same line, delete "fuel" and insert ---- fluid ----.

UNITED STATES PATENT AND TRADEMARK OFFICE

CERTIFICATE OF CORRECTION

PATENT NO. : 4,445,484

DATED : May 1, 1984

INVENTOR(S) : Gerard Marion

It is certified that error appears in the above-identified patent and that said Letters Patent is hereby corrected as shown below:

Column 5, line 4, after "housing" insert ---- means ----.

Column 5, line 9, after "head" insert ---- portion ----.

Column 5, line 10, delete "extreme" and insert ---- predetermined ----.

Column 5, line 12, before "through" insert ---- means ----.

Column 5, line 16, after "passageway" insert ---- means ----.

Column 5, line 29, delete "pressurized" and insert ---- selectively operable pressurizing ----.

Column 5, line 31, delete "injection" and insert ---- injecting ----. Same line, after "into" insert ---- a ----.

Column 5, line 58, delete "portions" and insert ---- portion ----.

Column 5, line 67, delete "Proximate" and insert ---- proximate ----.

Column 6, line 18, after "piston" insert ---- valve ----.

Column 6, line 19, before "cavity," insert ---- enlarged ----.

Column 6, line 51, before "pressurizing" insert ---- selectively operable ----.

UNITED STATES PATENT AND TRADEMARK OFFICE

CERTIFICATE OF CORRECTION

PATENT NO. : 4,445,484

DATED : May 1, 1984

INVENTOR(S) : Gerard Marion

It is certified that error appears in the above-identified patent and that said Letters Patent is hereby corrected as shown below:

Column 6, line 55, delete "fluid supply" and insert ---- fuel supply means ----.

Column 6, line 58, after "piston" insert ---- means ----.

Signed and Sealed this

*First* Day of *January 1985*

[SEAL]

*Attest:*

*Attesting Officer*

GERALD J. MOSSINGHOFF

*Commissioner of Patents and Trademarks*